United States Patent [19]

Bäumler et al.

[11] 4,254,905

[45] Mar. 10, 1981

[54] CENTRIFUGE ROTOR CONSTRUCTION

[75] Inventors: Jürgen Bäumler; Gerhard Schröter, both of Osterode, Fed. Rep. of Germany

[73] Assignee: Heraeus Christ GmbH, Osterode, Fed. Rep. of Germany

[21] Appl. No.: 26,742

[22] Filed: Apr. 3, 1979

[30] Foreign Application Priority Data

Apr. 5, 1978 [DE] Fed. Rep. of Germany ..... 2814589

[51] Int. Cl.[3] ..... B04B 9/12

[52] U.S. Cl. ..... 233/26

[58] Field of Search ..... 233/26, 1 R, 3, 4; 366/200, 201, 213, 214

[56] References Cited

U.S. PATENT DOCUMENTS

| | | | |
|---|---|---|---|
| 3,393,864 | 7/1968 | Galasso | 233/26 |
| 3,752,390 | 8/1973 | Chulay | 233/26 |
| 3,935,995 | 2/1976 | Williams | 233/26 |

FOREIGN PATENT DOCUMENTS

| | | | |
|---|---|---|---|
| 2326492 | 12/1974 | Fed. Rep. of Germany | 233/26 |
| 365169 | 3/1973 | U.S.S.R. | 233/26 |

*Primary Examiner*—Robert W. Jenkins

*Attorney, Agent, or Firm*—Frishauf, Holtz, Goodman & Woodward

[57] ABSTRACT

To provide for resilient hanging and outwardly swinging support of sample holder cups to be placed on the rotor of a centrifuge, a ring-shaped element is located axially offset from the holding portion for the cups of the rotor, the ring-shaped element having axially extending bores formed therein into which rod or strip spring elements are inserted, extending essentially axially along the rotor axis and then being bent over laterally outwardly and terminating in an L or P-shaped hook end so that the sample holder cups can be hooked therein for outward swinging movement. Preferably, the rotor and the sample holder cups are formed with interengaging abutments to limit outward movement of the cups during operation. The rotor itself is preferably formed with a groove to receive the horizontally extending portion of the spring elements. Additional restraining means can be provided to restrain undue deflection of the spring elements during rotor operation.

10 Claims, 6 Drawing Figures

CENTRIFUGE ROTOR CONSTRUCTION

The present invention relates to a centrifuge, and more particularly to a rotor construction which is capable of accepting sample cups, each one holding a multitude of sampling elements, in which the cups generally hang downwardly when the centrifuge is stopped, but can swing out laterally under centrifugal force during operation of the centrifuge.

BACKGROUND AND PRIOR ART

Centrifuges of the type to which the present invention relates are described in the literature, see, for example, German Disclosure Documents DE-OS No. 23 26 492 and German Pat. No. 23 11 234 (corresponds to U.S. Ser. No. 240,968, filed Apr. 4, 1972, now U.S. Pat. No. 3,752,390, Chulay). These two disclosure documents describe different solutions for the suspension of sample holder cups. The holder cups are retained on the rotor by a spring element which is secured to the rotor in bores positioned in a plane transverse to the axis of rotation of the rotor. These bores reduce the effective material diameter of the rotor and thus decrease its strength.

THE INVENTION

It is an object to provide a centrifuge, and more specifically a rotor therefor, in which the sample holder cup body is not weakened by bores, or the like, and which permits swinging-out of the sample holder cups, during centrifuge operation, without introducing frictional losses at the pivot points which are material. Basically, therefore, it is an object to improve the rotor construction so that it is stronger than heretofore used rotors while introducing only negligible friction losses.

Briefly, a holder portion is positioned beneath the rotor body, that is, axially offset from the rotor body, and formed with axially extending bores into which spring elements are inserted; the spring elements are formed with hooked ends remote from the insertion end to permit acceptance of cross pins formed on the sample holder cups. The spring elements can tilt outwardly under centrifugal force; excessive movement is prevented by abutments formed on the rotor engaging the cups themselves as they swing outwardly.

Drawings, illustrating a preferred example, wherein.

Figure 1:
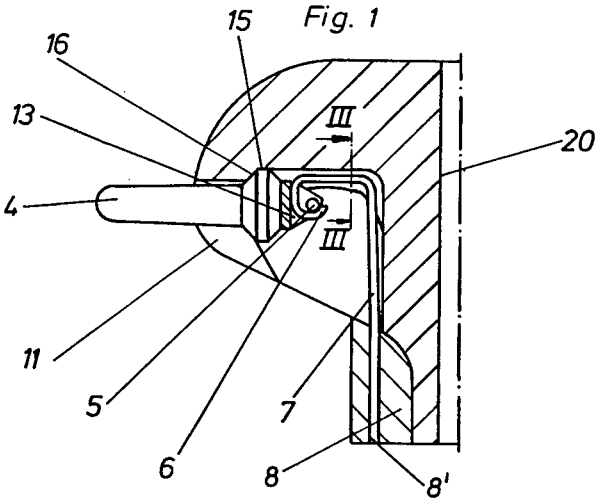
FIG. 1 is a half longitudinal section of a fragment of the rotor, in operation, showing the sample holder cup swung out under centrifugal force.
Figure 2:
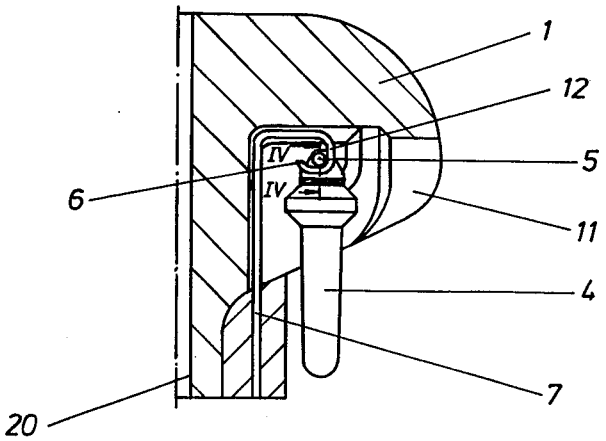
FIG. 2 is a view similar to FIG. 1, rotated 180°, and showing the sample holder structure at rest.
Figure 3:
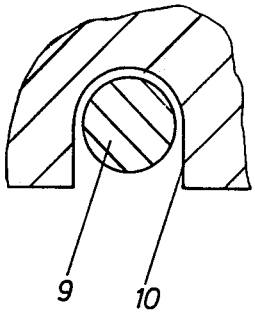
FIG. 3 is a greatly enlarged cross section along lines III—III of FIG. 1.
Figure 4:
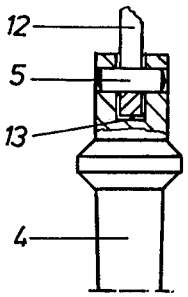
FIG. 4 is a greatly enlarged cross section, partly in end view, along lines IV—IV of FIG. 2.
Figure 5:
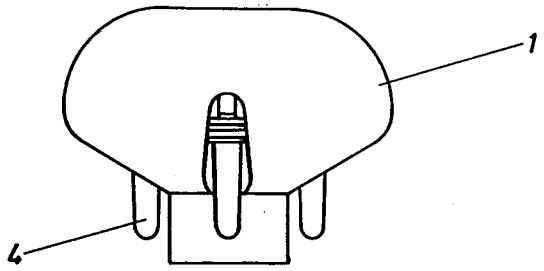
FIG. 5 is a side view of the rotor at rest, for use with four sample holder cups.
Figure 6:
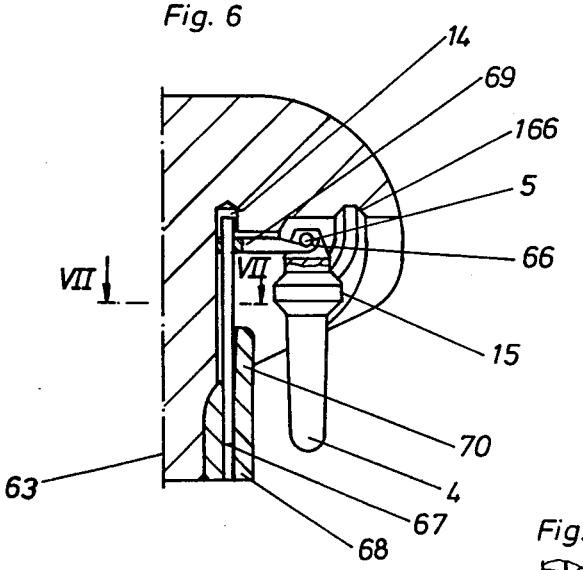
FIG. 6 is a fragmentary cross-sectional view similar to FIG. 2 and illustrating another embodiment.
Figure 7:
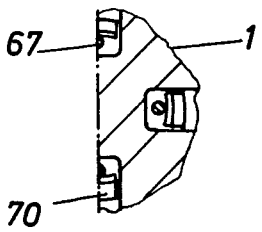

The rotor 1 is adapted to be seated on a shaft—not shown—and bearing with the inner surface 20 against the outer surface of the shaft. A drive motor, not shown, rotates the rotor about the axis of rotation 63 (FIG. 6). A plurality of cup-shaped holders 4 receive sample pippettes containing substances to be centrifuged. Other structures, such as small plastic bags or other suitable containers may be placed within the cup holders 4. The cup holders 4 have transversely extending pins 5 which permit the cup holders to swing from an essentially vertical direction—FIGS. 2 and 6—to a horizontal direction —FIG. 1—when the centrifuge is in operation. The pins 5 are engaged in hooks 6 which are formed at the end portions 12 of a spring rod 7. The spring rod 7 is angled off at the upper portion to extend essentially horizontally to form at its forward end an L or an inverted P shape. One rod 7 is provided for each sample holder cup 4. A suitable number for a centrifuge is, for example, four (FIG. 5) or six. The holder rods 7 are engaged in a ring-shaped holding element 8. The holding element 8 is formed with longitudinal bores 8' into which the holder rods or bars 7 are inserted. The direction of the bores 8' is essentially parallel to the axis of rotation 63 of the centrifuge rotor 1. Section III—III, FIG. 3, shows that the bent-over portion 9 of the holder bar 7 is lateral guided in a groove 10 formed in the rotor 1. Other ways of guiding the portion 9 can be used, for example formation of projections, shoulders on the rotor 1, or the like. Guiding the rods 7 horizontally results in reliable operation and prevents excessive bending of the rods 7 under the centrifugal force exerted thereon during operation. FIG. 4 illustrates in detail the hook-in arrangement between the end portion 12, fitting in a groove 13 of the holder and retained on the holder by pin 5.

The rotor 1 does not have any bores or other weakening openings to receive the rods 7. The general openings 11 to receive the swing-out sample holder cups 4, and the hanger arrangement therefor, is so shaped that the friction of movement of the cups 4, under centrifugal force, is low. In the structure as shown, the opening 11 in the rotor 1 is so shaped that the sample holder cups 4 can readily swing outwardly over the hanger pin 5 in the horizontal direction. Only the friction in the range of the pin 5 has to be overcome, a friction which is practically negligible in operation.

As the rotor rotates at higher and higher speeds, the spring rod 7 will resiliently deflect outwardly due to its own mass as well as due to the centrifugal forces placed thereon by the weight of the sample holder 4 and its contents. Excessive deflection of the rod 7 is prevented, however, by engagement of ridge 15 formed on the holder cup 4 against an inwardly extending ridge 16 formed on the rotor body 1. This permits support of the region 12 of the rod 7 at the ground of groove 13 at the point where the region 12 is bent over to form the hook 6.

In the embodiment of FIG. 6, the rod 67 is a straight element to which a horizontal portion 69 has been attached, having the hook end 66 thereon. The rod 67 fits into an opening 14 formed inwardly of the rotor, permitting the rod 67 to bear thereagainst and preventing excessive outward deflection upon rotor operation. Additionally, the cups 4 support themselves by means of the ridge 15 in a groove 166 formed in the rotor body. The horizontally extending portion 69 projecting outwardly from the rod 67 is stiff, rigid, and not flexible. The rods 67 fit into the ring-shaped body 68, positioned axially downwardly from the rotor body 1.

Various changes and modifications may be made, and features described in connection with one embodiment may be used with the other, within the scope of the inventive concept.

In the embodiment of FIGS. 1-4, the horizontal portions 9 of the spring element 7 are not directly restrained from outward movement, bearing, essentially, against the cups 4 during operation; the cups 4, in turn, are supported against outward movement by the interengaging ridges 15, 16. In the embodiment of FIG. 6, the rod 67 itself is restrained against outward movement in addition to the support provided, by a shallow groove or notch 14, just large enough to accept a short projecting tip at the end of rod 67 but not deep enough to weaken the body of rotor 1.

We claim:

1. In combination with a centrifuge to centrifuge substances retained in centrifuging cups (4), a centrifuge rotor construction having a rotor body (1);

elongated spring means (7, 67) rotating with the rotor and having a first portion (9, 69) extending essentially horizontally and outwardly away from the axis of rotation; and a hooked end (6) to receive engagement means (5) formed on the cups, the hooked end being positioned to permit the cups to hang vertically when the centrifuge is stopped and to swing outwardly under centrifugal force during operation of the centrifuge;

and means to secure the elongated springs to the rotor body comprising, a holding portion (8, 68) positioned beneath the rotor body (1) and axially offset from the hooked end (6) of the spring means (7, 67);

a second portion formed on the spring means and extending essentially parallel to the axis of rotation of the centrifuge;

and bores (8') formed in the holding portion and extending essentially parallel to the axis of rotation (63) of the rotor body, the second portion of the spring means being located at least in part in said bores and held therein.

2. Structure according to claim 1, wherein the spring means (7) are rod or strip springs, and the hooked end (6) is integrally joined to said essentially horizontal portion.

3. Structure according to claim 2, wherein the hooked end (6) is essentially L or P-shaped, to form the hook for engagement with a cross pin (5) on the cups (4) and forming said engagement means.

4. Structure according to claim 2, further including guide means (10) formed in the rotor body adjacent said horizontal portion (9, 69) and guiding resilient movement of said spring means therein.

5. Structure according to claim 4, wherein said guide means comprises a groove or notch formed in the region (11) of the rotor body adjacent said horizontal portion.

6. Structure according to claim 2, wherein said holding portion comprises a ring element (8, 68) surrounding at least in part of rotor body (1) beneath the region (11) of suspension of the cups (4).

7. Structure according to claim 6, further comprising projecting arm means (70) supported from said ring element (8) and supporting the essentially axially parallel second portion of the spring means.

8. Structure according to claim 2, wherein (FIG. 6) the essentially axially parallel second portion of the spring means is longer than the point of branch-off of said horizontal portion (69);

and the rotor body (1) is formed with a recess (14) accepting said longer projection to prevent undue outward deflection of the essentially axially parallel portion in operation of the centrifuge.

9. Structure according to claim 8, wherein the recess (14) is a shallow notch just deep enough to receive the longer projection of the horizontal portion (69) without weakening the body of the rotor (1).

10. Structure according to claim 2, wherein the rotor body (1) is formed with projecting means (16) shaped to engage the cups (4) when the cups are swung outwardly under centrifugal force during operation of the centrifuge;

and the essentially horizontal first portion and the hooked end (6) of the spring means are positioned to bear against the engagement means of the cup (4) to support the essentially horizontal portion of the elongated spring means in operation of the centrifuge.

* * * * *